US010932979B2

(12) United States Patent
Kaneyama

(10) Patent No.: US 10,932,979 B2
(45) Date of Patent: Mar. 2, 2021

(54) HEALTH APPLIANCE AND METHOD OF USING SAME

(71) Applicant: Ryutaku Kaneyama, Kanagawa (JP)

(72) Inventor: Ryutaku Kaneyama, Kanagawa (JP)

( * ) Notice: Subject to any disclaimer, the term of this patent is extended or adjusted under 35 U.S.C. 154(b) by 468 days.

(21) Appl. No.: 15/514,937

(22) PCT Filed: Sep. 18, 2015

(86) PCT No.: PCT/JP2015/076719

§ 371 (c)(1),
(2) Date: Mar. 28, 2017

(87) PCT Pub. No.: WO2016/056382

PCT Pub. Date: Apr. 14, 2016

(65) Prior Publication Data

US 2017/0216124 A1 Aug. 3, 2017

(30) Foreign Application Priority Data

Oct. 6, 2014 (JP) ..... JP2014-205505
Jul. 28, 2015 (JP) ..... JP2015-148924

(51) Int. Cl.
*A61H 1/02* (2006.01)
*A61H 1/00* (2006.01)
*A63B 23/04* (2006.01)

(52) U.S. Cl.
CPC ..... *A61H 1/024* (2013.01); *A61H 1/008* (2013.01); *A63B 23/04* (2013.01); *A61H 2201/0107* (2013.01); *A61H 2201/0192* (2013.01); *A61H 2201/1253* (2013.01); *A61H 2201/1269* (2013.01); *A61H 2201/164* (2013.01); *A61H 2201/1635* (2013.01);
(Continued)

(58) Field of Classification Search
CPC ..... A61H 1/02; A63B 23/04
See application file for complete search history.

(56) References Cited

U.S. PATENT DOCUMENTS

2013/0197403 A1 8/2013 Sevy et al.
2014/0073998 A1 3/2014 Keiser

FOREIGN PATENT DOCUMENTS

JP 59-177050 A 10/1984
JP 62-046046 U1 3/1987
(Continued)

OTHER PUBLICATIONS

Office Action dated Apr. 16, 2019 issued in the corresponding Japanese patent application No. 2015-148924.

*Primary Examiner* — Matthew W Schall
(74) *Attorney, Agent, or Firm* — Carrier Blackman & Associates, P.C.

(57) ABSTRACT

Provide is a health appliance and a method using the same which achieve active and appropriate assistance of bending of a knee joint. The health appliance, which allows a user lying or seated to move their knee joint while supporting the knee joint, includes a support 1 which is a triangular prism having one side surfaces as a bottom surface 11, and an aid 2 mounted on the leg below the knee and can be pulled by the user. The support 1 has a width W at which one knee is supported, and has a cross section forming a triangle with a base corresponding to one side surface 11 and an acute diagonal angle θ1. When sandwiched under the user's knee, the base angle θ2 adjacent to the toe is larger than the diagonal angle θ1 and smaller than the base angle θ3 adjacent to the thigh.

8 Claims, 6 Drawing Sheets

(52) U.S. Cl.
CPC ..... *A61H 2201/1685* (2013.01); *A61H 2203/0425* (2013.01); *A61H 2203/0443* (2013.01); *A61H 2203/0456* (2013.01); *A61H 2205/102* (2013.01)

(56) References Cited

FOREIGN PATENT DOCUMENTS

| | | | |
|---|---|---|---|
| JP | 11-009398 | A | 1/1999 |
| JP | 2001-037591 | A | 2/2001 |
| JP | 3081631 | U | 11/2001 |
| JP | 2002-028193 | A | 1/2002 |
| JP | 3093917 | U | 5/2003 |
| JP | 2005-296237 | A | 10/2005 |
| JP | 3157654 | U | 2/2010 |

HEALTH APPLIANCE AND METHOD OF USING SAME

TECHNICAL FIELD

The present invention relates to a health appliance and a method of using the same which allow a user lying on the back or in a seated position to move a knee joint while the knee joint is supported.

BACKGROUND ART

As disclosed in Patent Literature 1, this sort of health appliance and a method of using the same conventionally involve a triangular prism cushion having one of its side surfaces as a bottom surface for supporting a knee joint.

As disclosed in Patent Literature 2, another health appliance is known which consists of two U-shaped pipes with their ends connected to each other and the height of the support on which the knee joint is put can be adjusted by adjusting the connection angle.

CITATION LIST

Patent Literature

Patent Literature 1: Japanese Patent Laid-Open No. 2002-28193

Patent Literature 2: Japanese Patent Laid-Open No. 2005-296237

SUMMARY OF INVENTION

Technical Problem

These conventional health appliances can support a knee joint from below at an appropriate height but cannot actively assist the bending movement of the knee joint.

To be specific, the appliance in Patent Literature 1 serves just as a cushion supporting the knee joint by sandwiching the whole thigh and calf and does not actively promote the movement of the knee joint.

The appliance in Patent Literature 2 supports the knee joint from directly below with pipes, which leaves the leg below the knee in a floating state which only swings the leg below the knee, and does not actively promote bending movement of the knee joint.

In Patent Literature 2, only the knee joint of one leg is supported by a pipe, and the other leg (passing under the pipe) is entangled with the one leg, thereby allowing the knee joint to move. This, however, forcibly pulls the floating leg supported only at the knee joint by the pipe from directly below, and applies excess load to the knee joint which is unsuitable for appropriate assistance of the bending movement.

It is an object of the present invention, which has been made to solve the above problems, to provide a health appliance and a method of using the same which achieve active and appropriate assistance of the bending movement of a knee joint.

Solution to Problem

A health appliance according to a first aspect of the invention adapted to allow a user lying on the back or in a seated position to move their knee joint while the knee joint is supported, the health appliance including: a support having a triangular prism shape having one side surface as a bottom surface; and an aid adapted to be mounted on a leg of the user below a knee and configured to be pulled by the user. The support has a triangular cross section having a width at which one leg is supported, the one side surface as a base, and an acute diagonal angle, and when the support is sandwiched under the knee of the user, a base angle adjacent to a toe is larger than the diagonal angle and smaller than a base angle adjacent to a thigh.

In the health appliance according to the first aspect of the invention, the support having a triangular prism shape having one side surface as a bottom surface has a triangular cross section having a width at which one leg is supported, the one side surface as a base, and an acute diagonal angle, and the support is positioned such that a base angle adjacent to a toe is larger than the diagonal angle and smaller than a base angle adjacent to a thigh when the support is sandwiched under the knee of the user. Therefore, with the knee raised, the side surfaces of the triangular prism fit to the thigh and the calf, and the knee joint and the portions above and below the knee joint are supported, while an appropriate gap space allowing the knee joint to move is formed along the placing face.

Moreover, the leg below the knee is pulled toward the thigh with the aid mounted on the leg of the user below the knee at the toe side and configured to be pulled by the user, thereby achieving active bending movement of the knee joint within the range of the gap space and thus preventing application of excess load on the knee joint.

It should be noted that the aid may be anything that can be brought into contact or wrapped around the leg below the knee to pull the leg below the knee, such as a towel, a washcloth, or simply a string.

As described above, the health appliance according to the first aspect of the invention enables active and appropriate assistance of the bending movement of the knee joint.

In the health appliance according to a second aspect of the invention related to the first aspect of the invention, the aid includes: a supporter adapted to be fixed to an ankle of the user; and a band joined to the supporter, and the band is configured to be able to be pulled by the user.

In the health appliance according to the second aspect of the invention, particularly the supporter is used as the aid fixed to the ankle, which enables to prevent an upward displacement than using a towel, a washcloth, or even simply a string, and thereby ensuring that the ankle portion is pulled with the band.

The health appliance according to the second aspect of the invention ensures continuous, active, and appropriate assistance of the bending movement of the knee joint.

In the health appliance according to a third aspect of the invention related to the second aspect of the invention, the supporter includes an engagement portion that can engage with a tip portion of a stick for assisting the user in attaching and detaching it to and from the ankle of the user.

In the health appliance according to the third aspect of the invention, when the aid is particularly the supporter fixed to the ankle, upward displacement is prevented and the ankle portion can be pulled with the band without a fail but the attaching and detaching process is complicated for the user. In particular, for a user who needs to exercise the bending movement of their knee joint, it is difficult to attach and detach the supporter by bending their knee.

For this reason, the supporter has the engagement portion that can engage with the tip portion of the stick for assisting the user in attaching and detaching it to and from the ankle, and the engagement portion is engaged with the tip portion of the stick to enable attaching and detaching, thereby reducing burden of attaching and detaching.

The health appliance according to the third aspect of the invention enhances the convenience of the user and ensures continuous, active, and appropriate bending movement of the knee joint.

In the health appliance according to a fourth aspect of the invention related to the first aspect of the invention, the support includes: a core member having a triangular prism shape made using a board and opened at both end surfaces, the core member having one side surface corresponding to the bottom surface, and a portion forming the diagonal angle filleted at a predetermined radius of curvature; and an elastic member attached across two side surfaces of the core member other than the one side surface and having a predetermined thickness.

In the health appliance according to the fourth aspect of the invention, the corner of the support of the diagonal angle is filleted; thus, the corner can be properly fitted to the inner side of the knee joint of the user. Further, the core member is hollow and configured by just attaching an elastic member to the core member, resulting in a health appliance which is lightweight, user-friendly, and better at assisting the bending movement of the knee joint.

In the health appliance according to a fifth aspect of the invention related to the fourth aspect of the invention, the predetermined radius of curvature is an average radius of curvature in a range of 0.3 to 2.5 cm, and the predetermined thickness is in a range of 0.5 to 4 cm.

In the health appliance according to the fifth aspect of the invention, the radius of curvature of a portion forming the diagonal angle and the thickness of the elastic member according to the fourth aspect of the invention are set to a preferred value, ensuring the advantageous effects of the fourth aspect of the invention.

A method of using a health appliance according to a sixth aspect of the invention adapted to allow a user lying on the back or in a seated position to move their knee joint while the knee joint is supported, the method including: positioning a support that has a triangular prism shape having one side surface as a bottom surface, and a triangular cross section having a width at which one leg is supported, the one side surface as a base, and an acute diagonal angle, such that when the support is sandwiched under a knee of the user, a base angle adjacent to a toe is larger than the diagonal angle and smaller than a base angle adjacent to a thigh; and mounting an aid, which is adapted to be able to be pulled by the user, on the leg of the user below the knee and pulling the leg below the knee toward the thigh with the aid to bend the knee joint.

In the method of using a health appliance according to the sixth aspect of the invention, the support having a triangular prism shape having one side surface as a bottom surface has a triangular cross section having a width at which one leg is supported, the one side surface as a base, and an acute diagonal angle, and the support is arranged such that a base angle adjacent to a toe is larger than the diagonal angle and smaller than a base angle adjacent to a thigh when the support is sandwiched under the knee of the user. Therefore, with the knee raised, the side surfaces of the triangular prism fit to the thigh and the calf, and the knee joint and the portions above and below the knee joint are supported, while an appropriate gap space allowing the knee joint to move is formed along the placing face.

Moreover, the leg below the knee is pulled toward the thigh with the aid mounted on the leg of the user below the knee and configured to be pulled by the user, thereby achieving active bending movement of the knee joint, while the movement being within the gap space, thus preventing application of excess load on the knee joint.

As described above, the method for using the health appliance according to the sixth aspect of the invention enables active and appropriate assistance of the bending movement of the knee joint.

DESCRIPTION OF EMBODIMENTS

Figure 1:
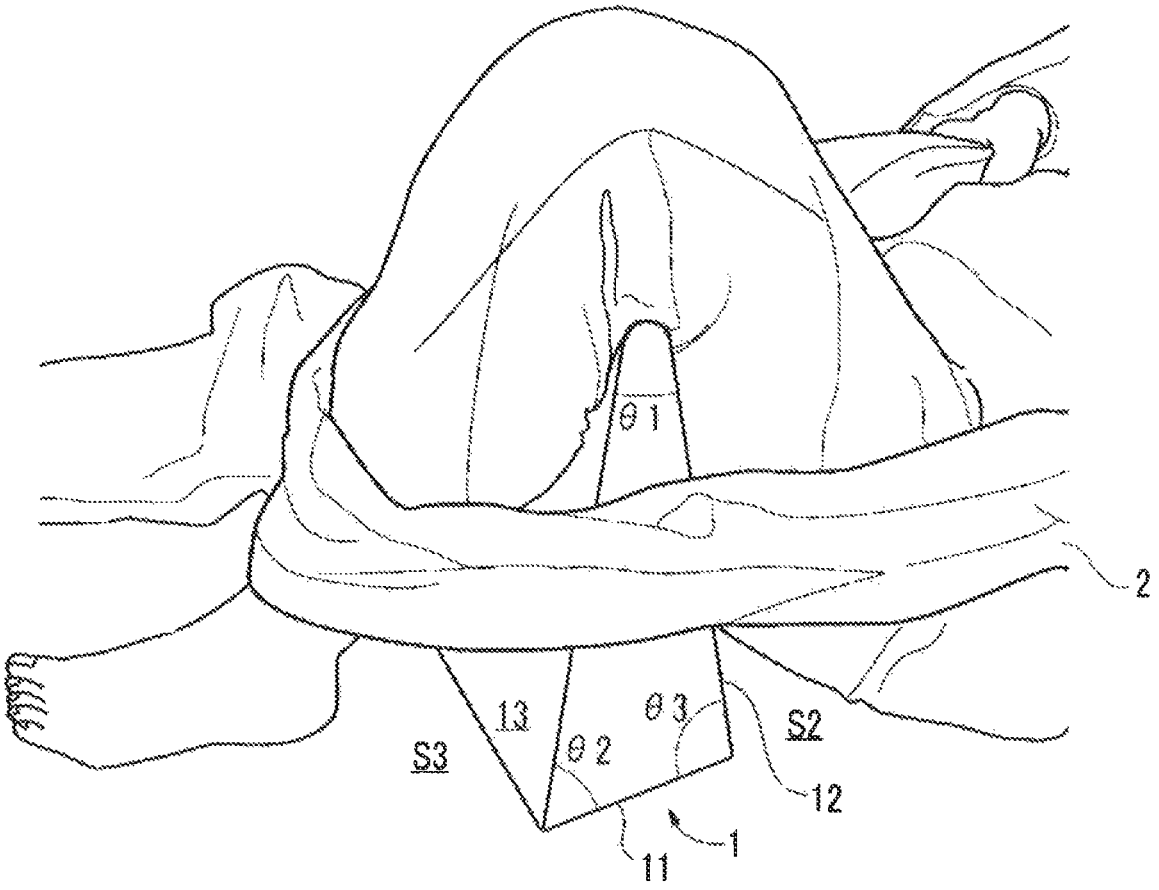
FIG. 1 is a perspective view illustrating a state of using a health appliance according to an embodiment.
Figure 2:
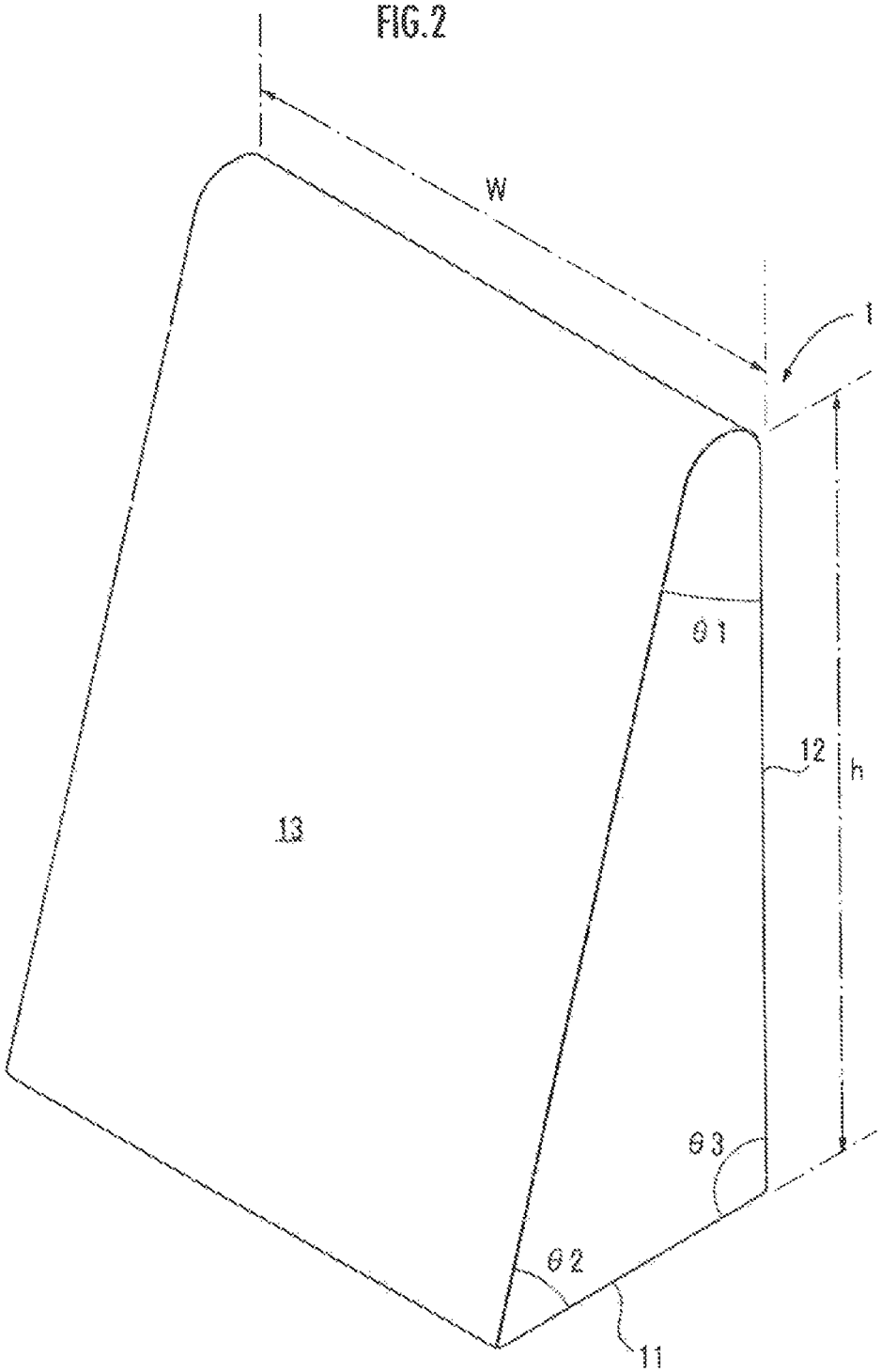
FIG. 2 is an enlarged view of a support shown in FIG. 1.

As shown in FIGS. 1 and 2, a health appliance according to this embodiment, which allows the user lying on the back or in a seated position to move their knee joint while the knee joint is supported, includes a support 1 which is a triangular prism having one of its side surfaces as a bottom surface 11, and an aid 2 that is mounted on the leg below the knee of the user and can be pulled by the user.

The support 1 is a member composed of, for example, urethane or a synthetic resin (foam resin), having a width W at which one knee is supported, and has a cross section forming a triangle which has a base corresponding to the one side surface 11 and an acute diagonal angle θ1. When it is sandwiched under the user's knee, the base angle θ2 adjacent to the toe is larger than the diagonal angle θ1 and smaller than the base angle θ3 adjacent to the thigh.

The diagonal angle θ1, which is the smallest angle among the three interior angles, is selected from among the range of 10° to 40°, preferably selected from the range of 15° to 25° and a larger angle is selected in a case of intending to reduce the load taking into account of the burden on the bending movement of the knee joint, and, in contrast, a smaller angle is selected in a case of intending to increase the load.

The base angle θ2 is selected from a range of 50° to 80°, preferably selected from the range of 65° to 75°. The largest base angle θ3 is selected from a range of 70° to 90°, preferably selected from a range of 80° to 90°.

The diagonal angle θ1 and the base angles θ2 and θ3 are set in these ranges to satisfy the above-described relationships. Consequently, when a knee joint of the user is supported directly above the diagonal angle θ1 in a state with their knee raised, a side surface 12 adjacent to the leg above the knee supports part of the thigh continuously from the knee joint, and a side surface 13 adjacent to the leg below the knee supports part of the calf continuously from the knee joint.

In a posture of the knee raised, when sandwiching the knee joint, the tilt angle of the leg above the knee is larger than the tilt angle of the leg below the knee. For this reason, a larger area of the side surface 12 can be fit to the thigh and a larger area of the side surface 13 can be fit to the calf by setting the base angle θ3 of the support 1 in the range of 70° to 90° (preferably 80° to 90°) and the base angle θ2 in the range of 50° to 80° (preferably 65° to 75°).

Accordingly, the side surfaces 12 and 13 of the triangular prism fit to the thigh and the calf, respectively, and the knee joint and the adjacent portions thereof can be stably supported, which offers a feeling of safety to the user of the health appliance.

Further, at the same time, appropriate gap spaces S2 and S3 that enable the movement of the knee joint are formed between the placing face of the support 1, on which the object is placed, and the thigh and the calf, respectively, and the user can bend their knee joint within the gap spaces S2 and S3.

The aid 2 assists such bending movement and may be anything that can be brought into contact or wrapped around the leg below the knee to pull the leg below the knee, such as a towel, a washcloth, or simply a string.

In this embodiment, a towel is used for the bending movement of a knee joint.

As shown in FIG. 1, the user places one leg on the support 1 which performs the bending movement of the knee joint, and puts the center of the towel on the ankle portion, and pulls both ends of the towel.

This allows the ankle portion to be pulled toward a body side with the knee joint being the fulcrum, thus allowing bending of the knee joint. At this time, the bending movement is performed within the gap spaces S2 and S3 formed between the placing face of the support 1, and the thigh and the calf, respectively.

Thus, the bending movement of the knee joint is active while being a bending motion within the gap spaces S2 and S3, and application of excess load on the knee joint is avoided.

As described above in detail, the health appliance and the method of using the same according to this embodiment enables active and appropriate assistance of the bending movement of the knee joint.

In this embodiment, the height h of the support 1 is selected as appropriate depending on the body shape or the like of the user.

A modification of the aid 2 will now be described referring to FIGS. 3 and 4. It should be noted that the components that have been described in the above embodiment will be denoted by the same respective reference numerals and their description will be omitted.

The aid 2 can be configured by a supporter 20 fixed to an ankle of the user.

The supporter 20 has a structure of, for example, a first fixer 21, which is wrapped around the ankle portion, and a second fixer 22 joined thereto, which is wrapped around the toe side leaving the heel uncovered, and includes a cutout 23 cutting out around the heel.

The first fixer 21 has an arc-shaped through hole 24 to be wrapped around the ankle and a band 25 passed therethrough and thus integrally formed with the through hole 24.

The supporter 20 has a ring-shaped engagement portion 26 at the first fixer 21, and a hook-shaped tip 28 of a stick 27 for assisting attaching and detaching can engage with the engagement portion 26.

The tip 28 is branched into two parts at the tip: a first bend 28*a* bending toward the user and a second bend 28*b* bending to the opposite side of the stick.

The bending movement of the knee joint using the supporter 20 will now be described.

The user first picks up the other end of the stick 27 and moves the supporter 20 toward the toe of the leg to be bent in a state the tip 28 (the first bend 28*a*) of the stick 27 being engaged with the engagement portion 26 of the supporter 20.

Figure 3:
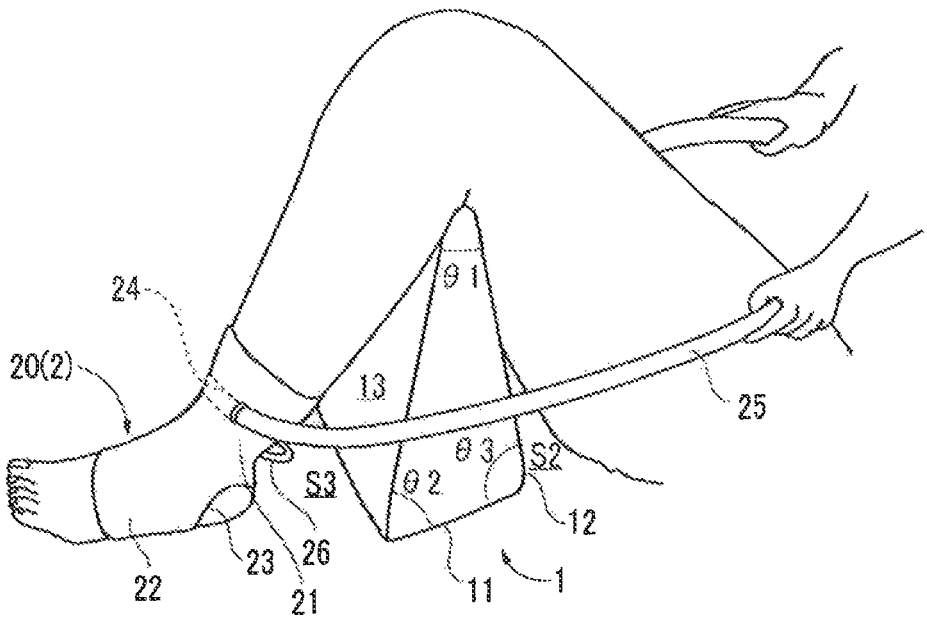
FIG. 3 is a perspective view illustrating a state of using a modification of the health appliance shown in FIG. 1.
Figure 4:
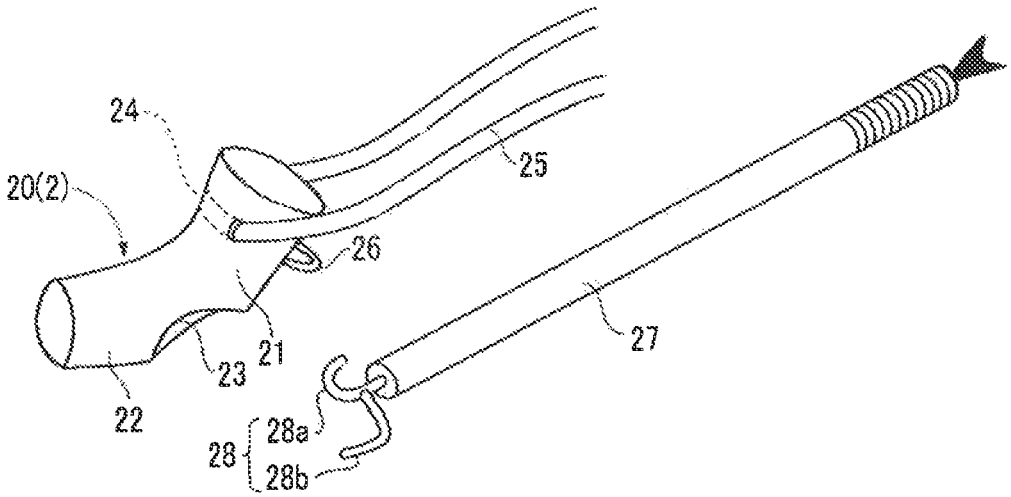
FIG. 4 is an explanatory diagram illustrating the structure of an aid shown in FIG. 3.

The user then passes the leg through the hole in the first fixer 21 of the supporter 20 and pulls up the supporter 20 such that the first fixer 21 comes to the ankle position and the second fixer 22 come close to the arch of the foot as shown in FIG. 3.

The user confirming that the supporter 20 is set to a predetermined position detaches the tip 28 (the first bend 28*a*) of the stick 27 from the engagement portion 26 of the supporter 20.

As described above, in a state the supporter 20 being set to the predetermined position, the user puts one leg, which has the supporter 20 set, on the support 1, and pulls forward both ends of the band 25.

At this time, for the supporter 20, the second fixer 22 prevents the first fixer 21 from being displaced upward pulled by the band 25. In particular, by using the supporter 20 fixed to the ankle as the aid 2, it is able to prevent upward displacement than using a towel, a washcloth, or even simply a string, and ensures that the ankle is pulled via the band 25.

Accordingly, the health appliance and the method of using the same according to this embodiment ensure continuous, active, and appropriate bending movement of the knee joint.

Subsequently, to end the bending movement, the tip 28 (the second bend 28*b*) of the stick 27 is engaged with the engagement portion 26 of the supporter 20 (in the opposite direction to the previous engagement with the first bend 28*a*), and the supporter 20 is detached from the opening side in the second fixer 22 with the use of the stick 27.

When particularly the supporter 20 fixed to the ankle is used as the aid in this manner, the attaching and detaching process is complicated but the load of attaching and detaching can be reduced because the supporter 20 is formed with the engagement portion 26 that can engage with the tip 28 (the first bend 28*a* and the second bend 28*b*) of the stick 27 for assisting the user in attaching and detaching it to and from the ankle, and the supporter 20 can be attached and detached with the use of the stick 27.

In particular, a user who needs to exercise the bending movement of their knee joint often has a difficulty in bending their knee for attaching and detaching the supporter 20, but this health appliance contributes to a dramatic reduction in burden on such a user attaching and detaching the supporter in such case.

As described above in detail, the health appliance and the method of using the same according to this embodiment enhance the convenience of the user and ensure continuous, active, and appropriate bending movement of the knee joint.

Figure 5:
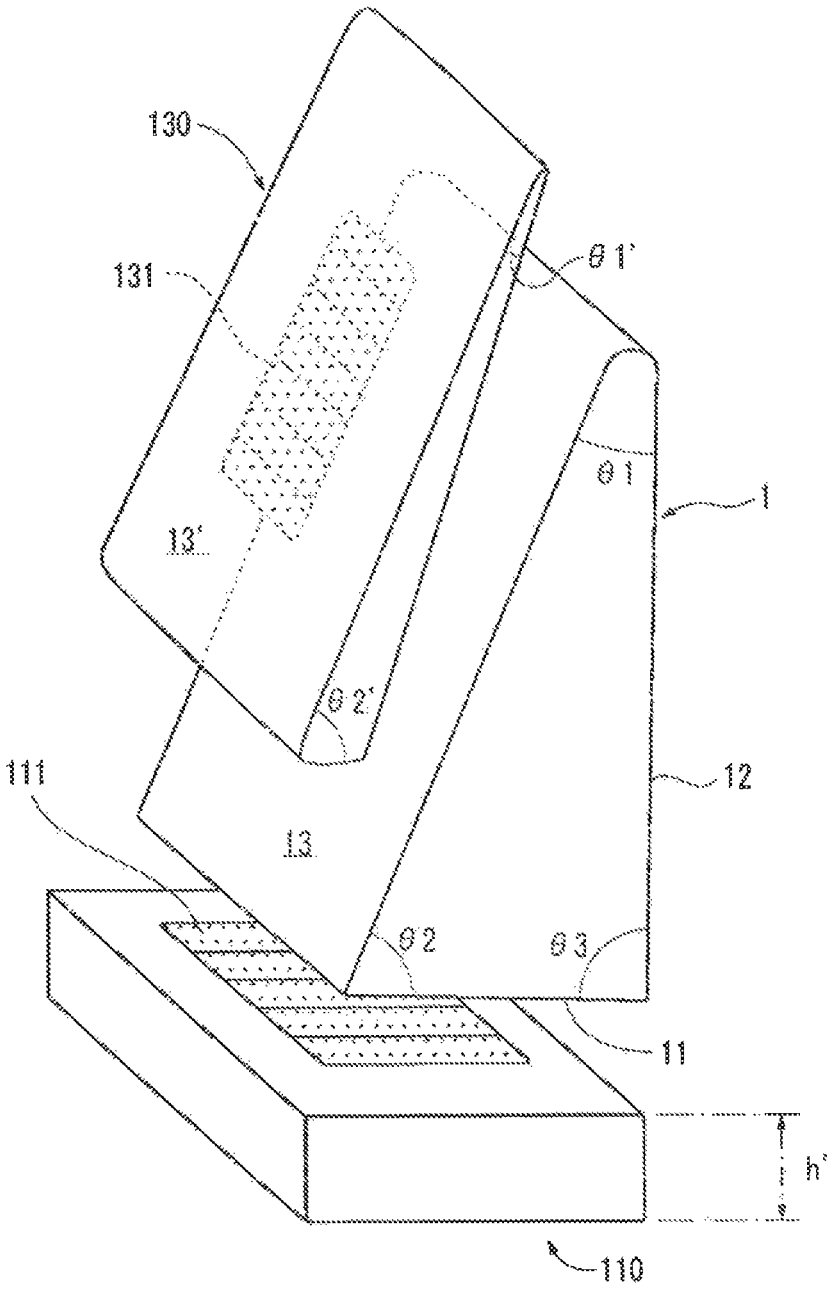
FIG. 5 is a diagram illustrating a modification of the support shown in FIG. 2.

Although in the above-described two embodiments, a case where the height h of the support 1, the diagonal angle θ1, and the base angles θ2 and θ3 are predetermined has been explained. However, it is not limited to such case and these parameters can be changed as shown in FIG. 5.

As for the height h, a seat 110 having a height h' may be mounted under the support 1, for example. Thus, the height of the support 1 can be adjusted to h+h'. Here, the seat 110 is preferably provided with a hook-and-loop fastener 111 or the like that can be freely attached and detached to/from the bottom surface 11 of the support 1.

Similarly, to change the diagonal angle θ1, a supplemental side member 130 may be mounted on the side surface 13. Hence, the diagonal angle θ1 can be adjusted to substantially θ1+θ1' in the range of 10° to 40° (preferably 15° to 25°). In addition, the base angle θ2 can be adjusted to θ2' in the range of 50° to 80° (preferably 65° to 75°). Here, the supplemental side member 130 is preferably provided with a hook-and-loop fastener 131 or the like that can be freely attached and detached to/from the side surface 13 of the support 1.

Instead of or in addition to attaching the supplemental side member 130 on the side surface 13, a similar supplemental side member (not shown in the drawing) may be mounted on the side surface 12.

Although the support 1 in this embodiment has a shape of one of the side surfaces of the triangular prism as a bottom surface, the triangular prism is not necessarily a right triangular prism and may be deformed as appropriate such that, for example, a portion supporting the knee joint is dented.

Further, although the tip 28 of the stick 27 according to this embodiment consists of the first bend 28*a* bending toward the user and the second bend 28*b* bending to the opposite side of the stick, this is not necessarily the case. For example, the first bend 28*a* may be provided at one end of the stick 27, and the second bend 28*b* may be provided at the other end of the stick 27.

Figure 6:
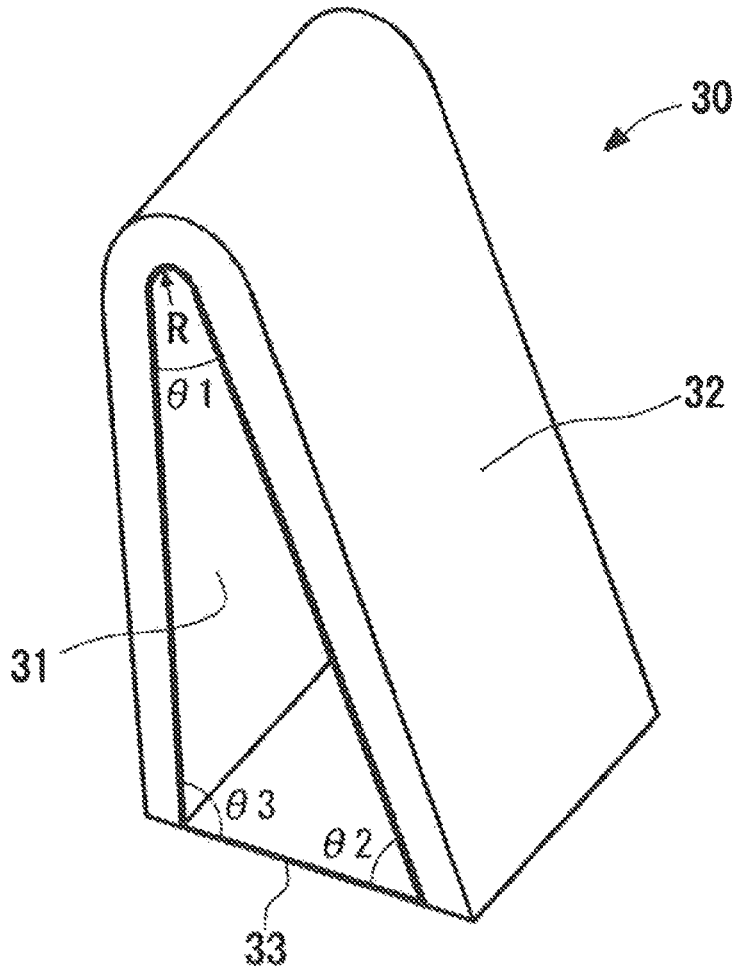
FIG. 6 is a perspective view of a support of a health appliance according to another embodiment of the present invention.

FIG. 6 is a perspective view of a support of a health appliance according to another embodiment of the present invention. As shown in FIG. 6, this support 30 of the health appliance includes a triangular prism shape core member 31 formed by a board material, and an elastic member 32 that is bonded to the core member 31 and has a uniform thickness. The core member 31 is hollow inside and both end faces of the triangular prism shape are opened.

The support 30 has a bottom surface 33 which is configured by one of the three side surfaces of the core member 31. The elastic member 32 is bonded to the entire two side surfaces of the core member 31 other than the bottom surface 33, lying from one surface to the other surface.

Here, as the board material used as the core member 31, an aluminum board having a thickness of about 2 mm is used. Instead of an aluminum board, a board made of another material, e.g., a plastic board or a plywood may be used. The material and thickness of the board should be selected so that the board can be strong enough for usage.

Here as the elastic member 32, a flexible polyurethane foam having a thickness of about 2 cm is used because it is lightweight and has excellent cushioning characteristics and durability. Since a flexible polyurethane foam provides a variety of levels of hardness, the health appliance allows selection of hardness depending on the user's preference, body type, and knee condition.

Instead of a urethane foam, a foam of another synthetic resin, rubber, sponge, or the like may be used. In this case, the thickness of the elastic member 32 may be determined as appropriate depending on the material used, elasticity, and hardness, for example. The thickness of the elastic member 32 is preferably in the range of 0.5 to 4 cm, more preferably in the range of 1 to 3 cm.

When the thickness is thinner than the range, the hardness of the core member 31 is directly propagated to the user and hinders the appropriate support of the user's knee joint, which may preclude usability. In contrast, if the thickness is thick, the weight of the support 30 is increased and may therefore hinder the appropriate support of the knee joint, which may similarly preclude usability.

The appropriate thickness of the elastic member 32 depending on the material varies within the above-described preferred range of the thickness of the elastic member 32. The thickness of the elastic member 32 may be entirely uniform or partially thick if necessary.

The diagonal angle θ1 adjacent to the knee joint, the base angle θ2 adjacent to the toe, and the base angle θ3 adjacent to the thigh, which are defined in the same manner as in FIG. 2 may be selected from the same respective ranges as in the above embodiment shown in FIGS. 1 to 5. It should be noted that here, the diagonal angle θ1 is set to 20°, the base angle θ2 is set to 70°, and the base angle θ3 is set to 90°, as more preferable values.

The corner of the core member 31 at the a diagonal angle θ1 is filleted at a predetermined radius of curvature. The normal preferred values of an average radius of curvature R of the outer edge of the corner is in the range of 0.3 to 2.5 cm, more preferably in the range of 0.7 to 1.5 cm. The radius of curvature R can be set to an appropriate value within the range depending on the user's body type, knee condition, age, and the like.

With the radius of curvature R in the above preferred range, when a polyurethane foam with a thickness of about 2 cm is bonded to the core member 31, the outer side of the corner adjacent to the diagonal angle θ1 has a radius of curvature of about 2.3 to 4.5 cm. With the radius of curvature R in the above more preferred range, the outer side of the corner adjacent to the diagonal angle θ1 has a radius of curvature of about 2.7 to 3.5 cm. The radius of curvature R may vary depending on the position in the filleted portion.

The height h and width W of the support 1 defined as shown in FIG. 2 are selected as appropriate depending on the body shape or the like of the user as described above. Here, the height h is selected from among, for example, about 260 mm, 290 mm, 320 mm, and 350 mm depending on the body shape or the like of the user.

The support 30 may configure the health appliance together with the aid 2 and may be used in the manner described above. Here, the user can bend the knee joint while keeping the polyurethane foam adjacent to the diagonal angle θ1 of the support 30 properly fitted to the inner side of the knee joint and the whole leg supported by the polyurethane foam.

Figure 7:
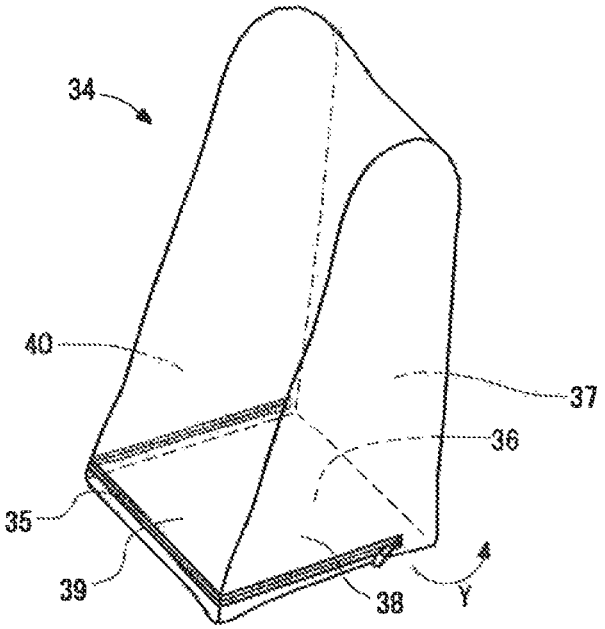
FIG. 7 is a perspective view of a cover for housing the support shown in FIG. 6.

FIG. 7 is a perspective view of a cover for housing the support 30. As shown in FIG. 7, the cover 34 has a shape generally fitted to the outer shape of the support 30. When the support 30 is contained in the cover 34, the cover 34 is configured so as to cover the entire support 30.

The cover 34 has a zip fastener 35 around a portion corresponding to the bottom surface 33 of the support 30 so that the bottom of the cover 34 can be opened and closed to house the support 30 in and out of the cover 34 and to take out from the cover 34.

To be specific, the zip fastener 35 is provided in a position generally parallel to the bottom surface portion 36 of the cover 34 corresponding to the bottom surface 33 of the support 30, and a little above the bottom surface portion 36. Note that the zip fastener 35 is not provided in the side surface portion 37 of the cover 34 corresponding to the side surface of the support 30 which forms the base angle θ3 with the bottom surface 33 of the support 30. In particular, the zip fastener 35 is provided in a U shape passing from a point in the side surface portion 38 (adjoining the side surface portion 37), which is in the vicinity of the side surface portion 37, to a point in a side surface portion 40 (adjoining the side surface portion 39), which is in the vicinity of the side surface portion 37, via a side surface portion 39 adjoining the side surface portion 38.

Hence, opening the zip fastener 35 allows the bottom surface portion 36 of the cover 34 to open in the direction of arrow Y while the boundary with the side surface portion 37 serves as a hinge. In this state, to contain the support 30 in the cover 34, the support 30 is inserted in the cover 34 from the diagonal angle θ1 side along the shape of the cover 34, the bottom surface portion 36 of the cover 34 is closed, and the zip fastener 35 is closed.

This embodiment provides a health appliance including the support 30 which is configured by the core member 31 and the elastic member 32 and therefore is lightweight, easy to use, and adequately strong. In addition, since the container cover 34 includes the zip fastener 35 that passes the above-described path, and it is able to facilitate opening and closing for housing the support 30.

REFERENCE SIGNS LIST

1, 30 . . . support, 2 . . . aid, 11, 33 . . . bottom surface, 12, 13 . . . side surface, 20 . . . supporter (aid), 21 . . . first fixer, 22 . . . second fixer, 23 . . . cutout, 24 . . . through hole (joint), 25 . . . band, 26 . . . engagement portion, 27 . . . stick, 28 . . . tip, 28*a* . . . first bend (tip), 28*b* . . . second bend (tip), θ1 . . . diagonal angle, θ2, θ3 . . . base angle, S2, S3 . . . gap space

The invention claimed is:

1. A health appliance adapted to allow a user lying on the back or in a seated position to move their knee joint while the knee joint is supported, the health appliance comprising:

a support having a triangular prism shape having one side surface as a bottom surface, a first solid side surface adjacent to a user's leg above a user's knee to support a user's thigh, said first side surface extending continuously from a user's knee joint to the top of a user's thigh, and a second solid side surface adjacent to a user's leg below the knee to support a user's calf, said second side surface extending continuously from the knee joint to the ankle; and an aid adapted to be mounted on a leg of the user below a knee and configured to be pulled by the user to pull the calf against the second side surface, wherein the support has a width at which one knee is supported, and a triangular cross section having a base on the bottom surface and an acute diagonal angle, and when the support is sandwiched under the knee of the user, and a base angle adjacent to a toe is larger than the diagonal angle and smaller than a base angle adjacent to a thigh.

2. The health appliance according to claim 1, wherein the aid comprises:

a supporter adapted to be fixed to an ankle of the user, said supporter having a first fixer configured to wrap around an ankle of a user and said fixer including a through hole therein, and a second fixer configured to wrap around a toe side of a user; and a band joined to the supporter by insertion through the through hole, and the band is configured to be able to be pulled by the user.

3. The health appliance according to claim 2, wherein the supporter comprises an engagement portion that can engage with a tip portion of a stick for assisting the user in attaching and detaching the supporter to and from the ankle of the user.

4. The health appliance according to claim 1, wherein the support comprises:

a triangular prism shape core member having a hollow inside, and having two opposing solid side surfaces with open end faces, made using a board material, the core member having one side surface corresponding to the bottom surface, and the portion forming the diagonal angle is filleted at a predetermined radius of curvature; and further including an elastic member bonded across the full length of the two side surfaces of the core member other than the bottom surface, covering the entirety of the first and second solid side surfaces of the core member and having a predetermined thickness.

5. The health appliance according to claim 4, wherein the predetermined radius of curvature is an average radius of curvature in a range of 0.3 to 2.5 cm, and the predetermined thickness is in a range of 0.5 to 4 cm.

6. A method of using a health appliance adapted to allow a user lying on the back or in a seated position to move their knee joint while the knee joint is supported, the method comprising:

positioning a support having a triangular prism shape including a bottom surface, a first solid side surface for positioning adjacent to a user's leg, extending continuously from the knee to the top of a user's thigh, and a second solid side surface for positioning adjacent to a user's leg extending from a user's knee to a user's ankle, having a width at which a user's knee is supported, a triangular cross section having a base on the bottom surface, and an acute diagonal angle, such that when the support is sandwiched under a knee of the user, a base angle adjacent to a toe is larger than the diagonal angle and smaller than a base angle adjacent to a thigh; and positioning a mounting aid on the leg of the user in the vicinity above the ankle.

7. The health appliance according to claim 1, further comprising a supplemental solid side member for removably attaching and detaching to the first side member or the second side member.

8. The health appliance according to claim 1, wherein a seat having a predetermined height is removably attached under the support.

* * * * *